US010123672B2

(12) United States Patent
Ji et al.

(10) Patent No.: US 10,123,672 B2
(45) Date of Patent: Nov. 13, 2018

(54) VACUUM CLEANER

(71) Applicant: LG ELECTRONICS INC., Seoul (KR)

(72) Inventors: Heonpyeong Ji, Seoul (KR); Youngho Kim, Seoul (KR); Hoikil Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 295 days.

(21) Appl. No.: 14/920,474

(22) Filed: Oct. 22, 2015

(65) Prior Publication Data

US 2016/0113457 A1 Apr. 28, 2016

(30) Foreign Application Priority Data

Oct. 22, 2014 (KR) ..... 10-2014-0143191

(51) Int. Cl.
*A47L 9/00* (2006.01)
*A47L 5/28* (2006.01)

(52) U.S. Cl.
CPC ..... *A47L 9/009* (2013.01); *A47L 5/28* (2013.01)

(58) Field of Classification Search
CPC ... A47L 9/009; A47L 5/28; A47L 9/00; A47L 9/22; B62D 11/00; A63C 17/22
See application file for complete search history.

(56) References Cited

U.S. PATENT DOCUMENTS 3,689,091 A * 9/1972 Nagin ..... A63C 17/18 280/11.12
7,607,196 B2 * 10/2009 Li ..... A47L 5/28 15/350
2009/0165242 A1 7/2009 Lee et al.

FOREIGN PATENT DOCUMENTS

| | | | |
|---|---|---|---|
| JP | U3084160 | | 12/2001 |
| KR | 2008-0089435 | A | 10/2008 |
| KR | 2009-0074582 | A | 7/2009 |
| WO | WO2007/034436 | * | 3/2007 |
| WO | WO2007034436 | * | 3/2007 |

OTHER PUBLICATIONS

Korean Office Action for Application 10-2014-0143191 dated Jan. 12, 2016 (full Korean text).

* cited by examiner

*Primary Examiner* — Robert Scruggs
(74) *Attorney, Agent, or Firm* — KED & Associates, LLP

(57) ABSTRACT

A vacuum cleaner may include a suction nozzle; a cleaner body in communication with the suction nozzle; a supporter configured to connect the cleaner body with the suction nozzle and to allow a position of the cleaner body with respect to the suction nozzle to be varied; and a wheel assembly rotatably connected to the supporter. The wheel assembly may include a frame, a wheel shaft installed at the frame, and a wheels installed at the wheel shaft to be independently rotated. A contact area between each of the wheels and a floor may vary according to a varied position of the cleaner body with respect to the suction nozzle.

12 Claims, 10 Drawing Sheets

VACUUM CLEANER

CROSS-REFERENCE TO RELATED APPLICATION

This application claims priority under 35 U.S.C. § 119 to Korean Application No. 10-2014-0143191, filed Oct. 22, 2014, the subject matter of which is incorporated herein by reference.

BACKGROUND

1. Field

Embodiments may relate to a vacuum cleaner.

2. Background

A vacuum cleaner is an apparatus that suctions dust and foreign substances scattered on a floor using a suction motor installed at an inside of a main body, and then filters the dust and the foreign substances in the inside of the main body.

The vacuum cleaner may be classified as an upright type in which a suction nozzle as an inlet port is integrally formed with the main body, and a canister type in which the suction nozzle is in communication with the main body through a connection tube.

Korean Patent Publication No. 2012-0083642, the subject matter of which is incorporated herein by reference, discloses an upright type vacuum cleaner (hereinafter referred to as a cleaner).

The cleaner may include a supporting unit that supports a load of the main body when the main body is inclined. When the main body is inclined at a predetermined angle or greater, the supporting unit is in contact with the floor (or surface), and the supporting unit supports the load of the main body.

The supporting unit may support the load. However, when a direction of the cleaner is changed, the supporting unit may not help until the main body of the cleaner is inclined at the predetermined angle. A weight may be increased by providing the supporting unit, and thus it may be hard for a user to change a direction of the cleaner.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to embodiments of the present disclosure, examples of which are illustrated in the accompanying drawings.

In the following detailed description, reference is made to the accompanying drawings that form a part hereof, and in which is shown by way of illustration specific embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the spirit or scope of the disclosure. To avoid detail not necessary to enable those skilled in the art to practice the disclosure, the description may omit certain information known to those skilled in the art. The following detailed description is, therefore, not to be taken in a limiting sense.

In the description of embodiments, terms such as first, second, A, B, (a), (b) or the like may be used herein when describing components of embodiments. Each of these terminologies is not used to define an essence, order or sequence of a corresponding component but is used merely to distinguish the corresponding component from other component(s). It should be noted that if it is described in the specification that one component is "connected," "coupled" or "joined" to another component, the former may be directly "connected," "coupled" and "joined" to the latter or "connected," "coupled" and "joined" to the latter via another component.

Figure 1:
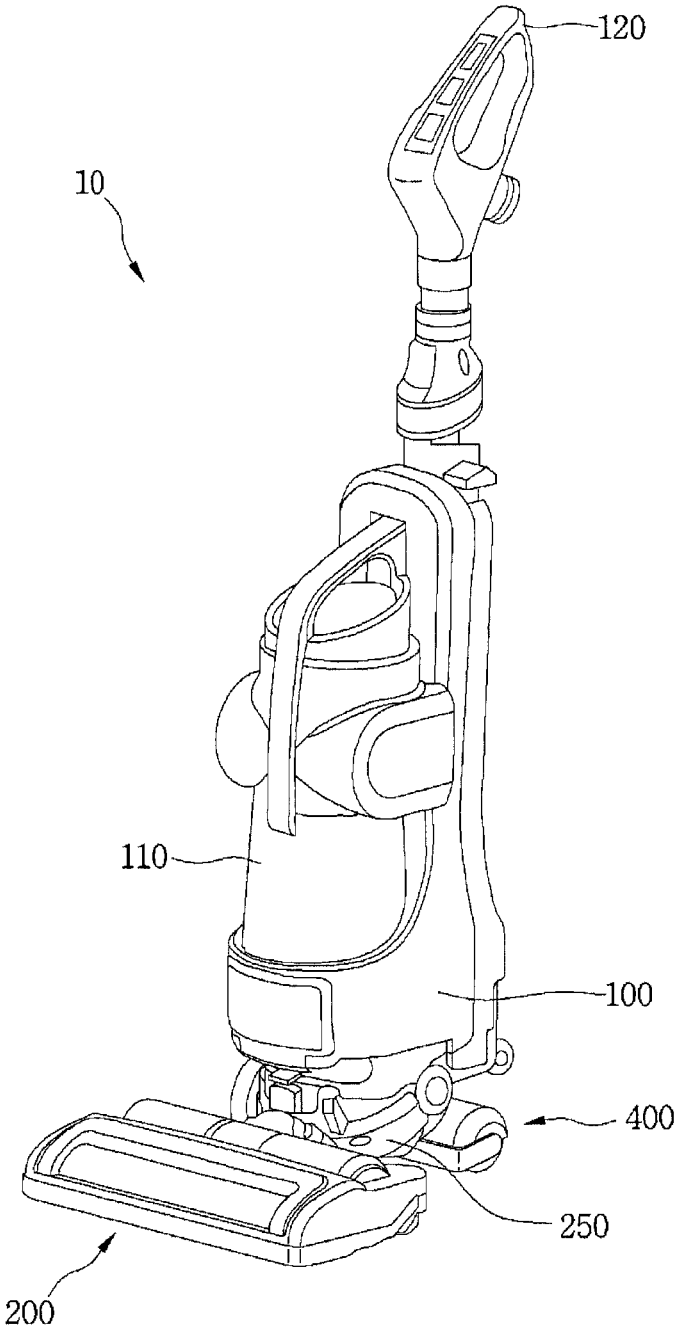
FIG. 1 is a perspective view of a vacuum cleaner according to an embodiment.
Figure 2:
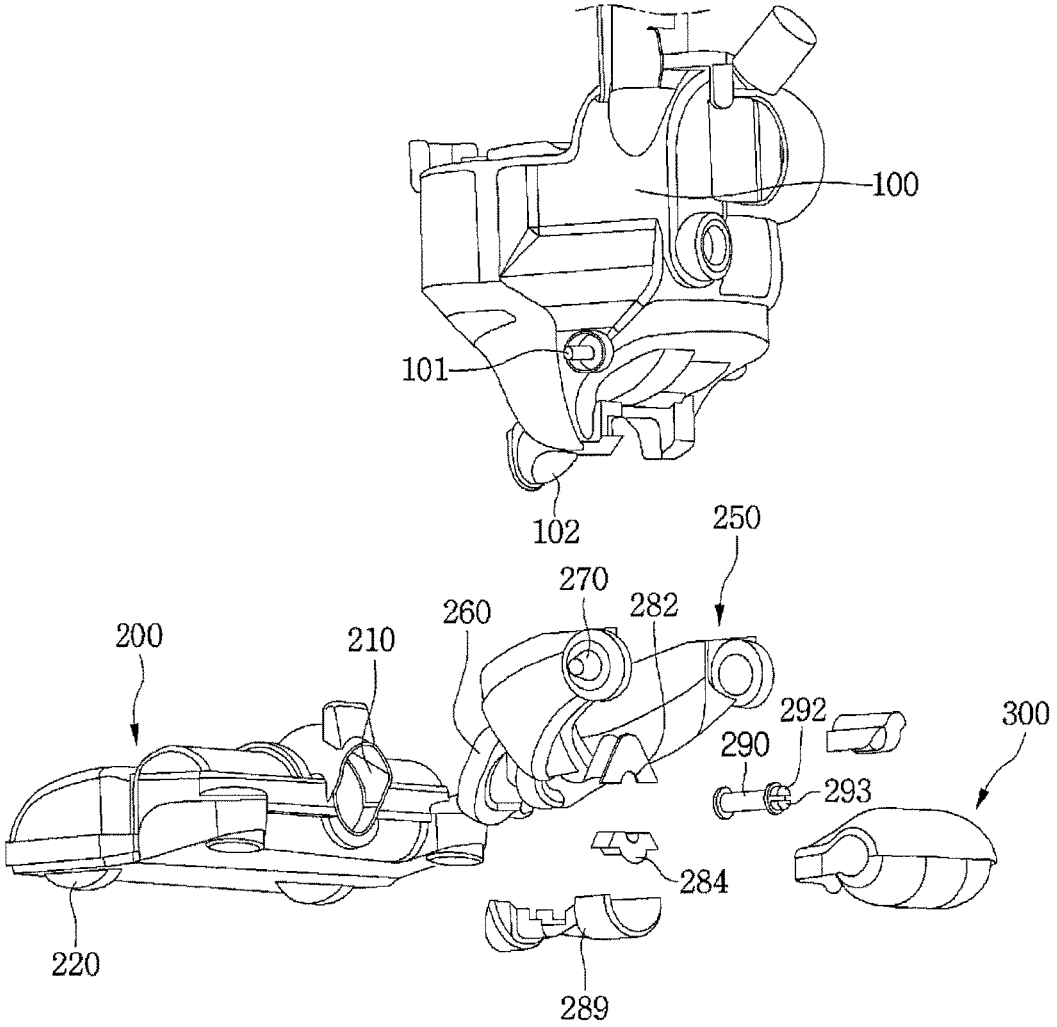
FIG. 2 is an exploded perspective view of the vacuum cleaner of FIG. 1.

FIG. 1 is a perspective view of a vacuum cleaner according to an embodiment. FIG. 2 is an exploded perspective view of the vacuum cleaner of FIG. 1. Other embodiments and configurations may also be provided.

FIG. 1 illustrates an upright type vacuum cleaner as an example of the vacuum cleaner. FIG. 2 illustrates only a part of a cleaner body.

Referring to FIGS. 1 and 2, a vacuum cleaner 10 may include a cleaner body 100 that has a suction motor, a suction nozzle 200 that is in communication with the cleaner body 100, a supporter 250 that allows a position of the cleaner body 100 to vary with respect to the suction nozzle 200, and a wheel assembly 300 that is rotatably connected with the supporter 250.

A dust separating and collecting device 110, which separates dust from suctioned air, and a handle 120, which is grasped by a user, may be provided at the cleaner body 100.

The cleaner body 100 may be in direct communication with the suction nozzle 200, or the cleaner body 100 may be in communication with the suction nozzle 200 through the supporter 250.

A shaft 101 may be provided at both sides of the cleaner body 100. The shaft 101 may be connected to the supporter 250 such that the cleaner body 100 is rotatable with respect to the supporter 250 in a first direction. For example, the cleaner body 100 may move up and down with respect to a first rotational center that extends left and right. The first direction may be a direction in which the cleaner body 100 rotates about the first rotational center.

The supporter 250 may include a shaft coupling part 270. The shaft 101 of the cleaner body 100 may be coupled to the shaft coupling part 270.

The suction nozzle 200 may include a first connection part 210. The supporter 250 may include a second connection part 260 that is rotatably connected to the first connection part 210.

The cleaner body 100 may rotate together with the supporter 250 with respect to the suction nozzle 200 in a second direction by the first connection part 210 and the second connection part 260. For example, the cleaner body 100 may rotate left and right about a second rotational center that extends forward and backward. The second direction may be a direction in which the cleaner body 100 rotates about the second rotational center.

A communication tube 102 may be provided at the cleaner body 100. The communication tube 102 may pass through the first connection part 210 and the second connection part 260.

The suction nozzle 200 may include an inlet port for suctioning air and dust.

One or more nozzle wheels 220, which allow the suction nozzle 200 to easily move along a floor, may be provided at the suction nozzle 200. FIG. 2 shows an example in which a plurality of nozzle wheels 220 are provided at the suction nozzle 200.

The supporter 250 and the wheel assembly 300 may be connected to each other by a connection shaft 290.

The supporter 250 may include a shaft seating part 282 at which one end of the connection shaft 290 is seated, a shaft supporting part 284 that supports a lower side of the connection shaft 290 seated at the shaft seating part 282, and a cover 289 that covers the shaft supporting part 284.

Each of the shaft seating part 282 and the shaft supporting part 284 may have a rounded part that allows the connection shaft 290 to rotate.

The other end of the connection shaft 290 may be connected to the wheel assembly 300. A plurality of hooks 292 and 293, which maintain a connected state with the wheel assembly 300, may be provided at the other end of the connection shaft 290. The plurality of hooks 292 and 293 are spaced apart from each other. While the plurality of hooks 292 and 293 are connected to the wheel assembly 300, the connection shaft 290 may rotate together with the wheel assembly 300.

An extension direction of the connection shaft 290 may be disposed to not be in parallel with an extension direction of the second rotational center. While the supporter 250 rotate with the cleaner body 100 about the second rotational center, the connection shaft 290 may relatively rotate with respect to the supporter 250, while being rotated with the supporter 250 in the same direction as a rotational direction of the supporter 250.

For example, the extension direction of the connection shaft 290 may also be a front-and-rear direction. An angle of the extension direction of the connection shaft 290 with respect to a horizontal line may be different from an angle of the second rotational center as a rotational center of the supporter 250 with respect to the horizontal line.

Figure 3:
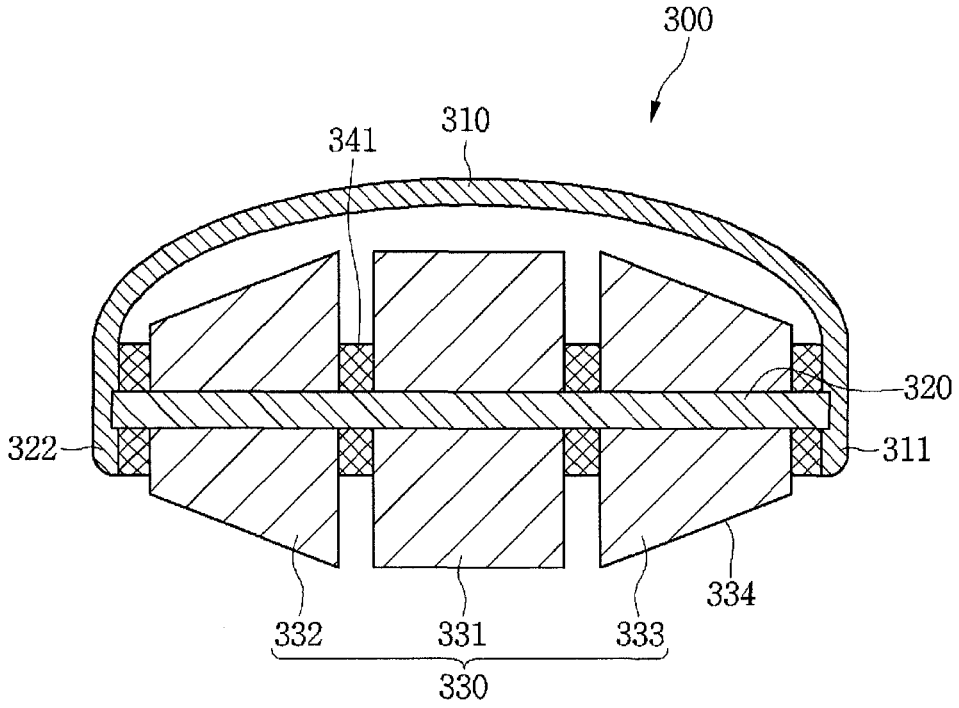
FIG. 3 is a cross-sectional view of a wheel assembly according to an embodiment.
Figure 4:
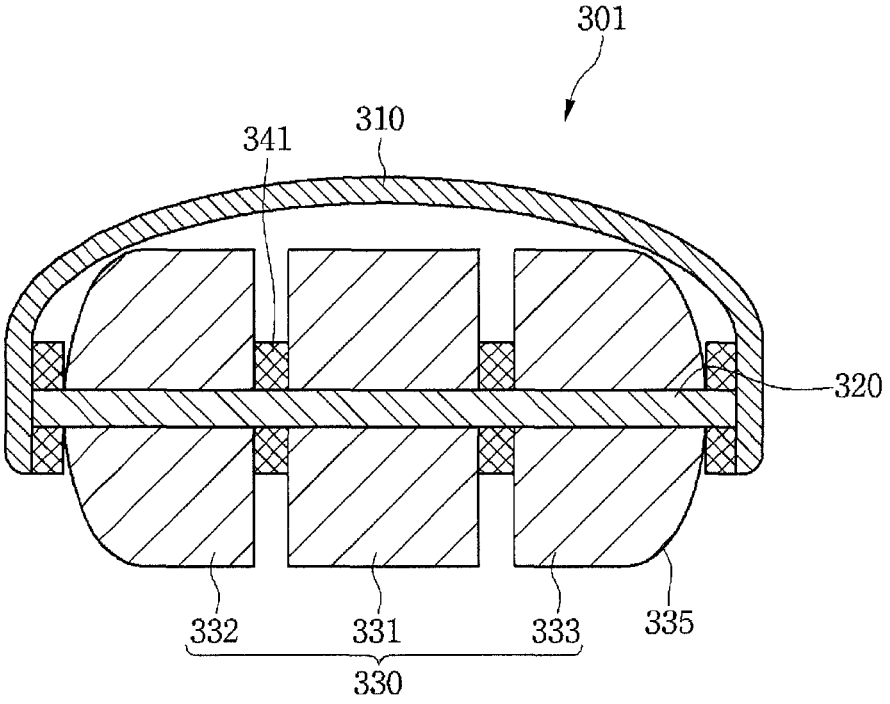
FIG. 4 is a cross-sectional view of a wheel assembly according to an embodiment.

FIG. 3 is a cross-sectional view of a wheel assembly according to an embodiment. FIG. 4 is a cross-sectional view of a wheel assembly according to an embodiment. Other embodiments and configurations may also be provided.

Referring to FIGS. 3 and 4, the wheel assembly 300 may include a frame 310. The connection shaft 290 may connect to the frame 310.

The frame 310 may include a plurality of shaft supporting parts 311 and 322. The plurality of shaft supporting parts 311 and 322 may be horizontally spaced apart from each other.

The wheel assembly 300 may further include a plurality of wheels 330. The plurality of wheels 330 may include a first wheel 331, a second wheel 332 and a third wheel 333. The second and third wheels are disposed at both sides of the first wheel 331. That is, the third wheel 333 is located at an opposite side of the first wheel 331 as compared to the second wheel 332.

The wheel assembly 300 may further include a wheel shaft 320. The plurality of wheels 330 may be rotatably installed at the wheel shaft 320.

Both sides of the wheel shaft 320 may be fixed to the shaft supporting parts 311 and 322 of the frame 310. That is, the plurality of wheels 330 may be located between the plurality of shaft supporting parts 311 and 322.

Shapes of the second wheel 332 and the third wheel 333 may be different from a shape of the first wheel 331.

Due to a difference in shapes, a contact area between the first wheel 331 and the floor (or surface) may be different from a contact area between the floor (or surface) and each of the second wheel 332 and the third wheel 333, while an external force is not applied to the cleaner body 100.

For example, while the external force is not applied to the cleaner body 100, the contact area between the first wheel 331 and the floor (or surface) may be larger than the contact area between the second wheel 332 and the floor (or surface) and the contact area between the third wheel 333 and the floor (or surface).

As the contact area between the floor and each of the plurality of wheels 330 is increased, a frictional force generated when the vacuum cleaner 10 is moved is increased. Thus, a force applied by the user to move the vacuum cleaner 10 is also increased.

Therefore, to reduce the contact area between the floor and each of the plurality of wheels 330, a part or whole of each of the second wheel 332 and the third wheel 333 may be spaced apart from the floor, while the external force is not applied to the cleaner body 100.

In order for a part or whole of each of the second wheel 332 and the third wheel 333 to be spaced apart from the floor, each of the second wheel 332 and the third wheel 333 may have a tapered portion.

The tapered portion may be an inclined portion 334, as shown in FIG. 3, or may be a rounded portion 335, as shown in FIG. 4.

The second wheel 332 and the third wheel 333 may have the same shape or may have different shapes from each other.

To prevent the plurality of wheels 330 from being interfered with each other while being independently rotated, an interference preventing part 341 may be provided between the plurality of wheels 330. The interference preventing part 341 may be provided between the second wheel 332 and the frame 310 and between the third wheel 333 and the frame 310.

Therefore, the plurality of wheels 330 may be independently rotated using the wheel shaft 320 as a rotational center.

When the vacuum cleaner 10 is moved forward and backward in a state in which the external force is not applied to the cleaner body 100, rotational speeds of the plurality of wheels 330 may be different from each other.

As shown in FIG. 3, when the vacuum cleaner 10 is moved forward and backward, the rotational speed of the first wheel 331 may be greater than that of each of the second wheel 332 and the third wheel 333. Alternatively, when the first wheel 331 is rotated, one or more of the second wheel 332 and the third wheel 333 may be maintained in a stopped state.

Figure 5:
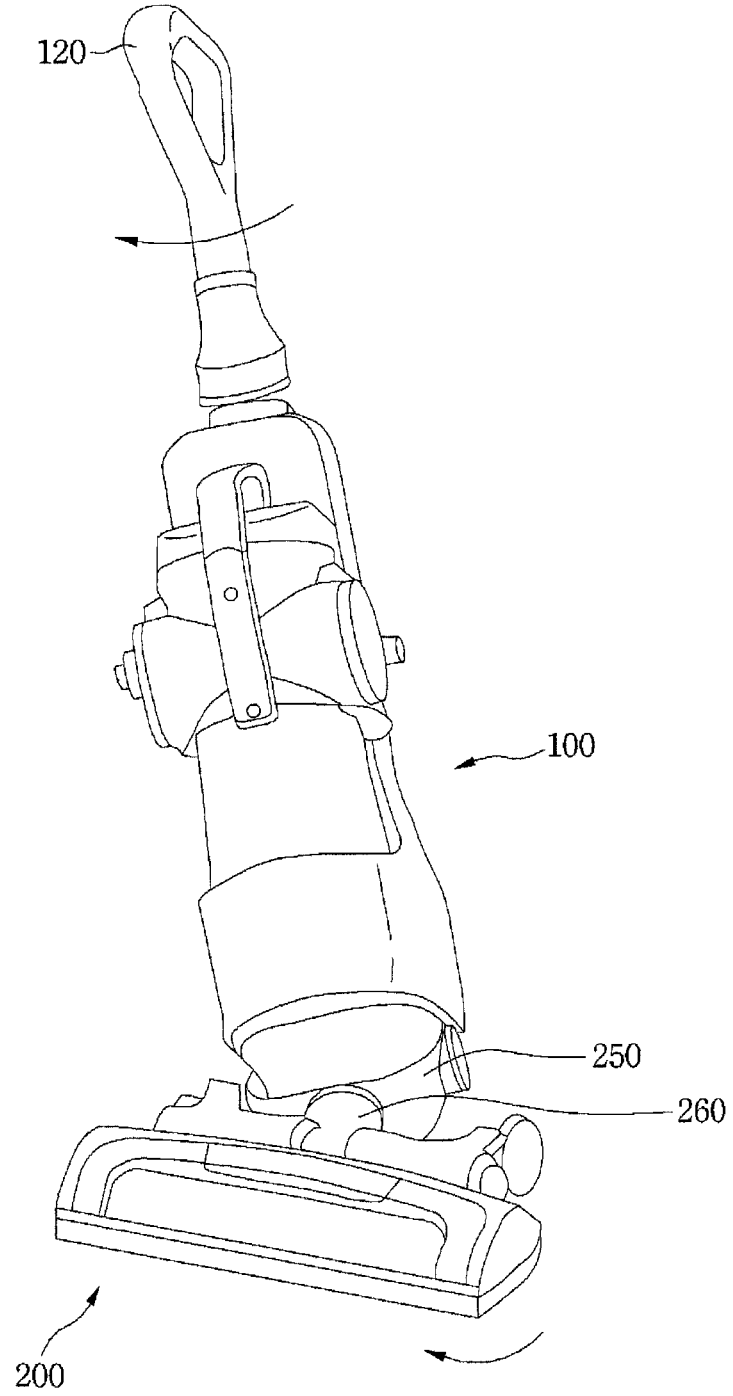
FIG. 5 is a view illustrating a state in which a cleaner body according to an embodiment is rotated right.
Figure 6:
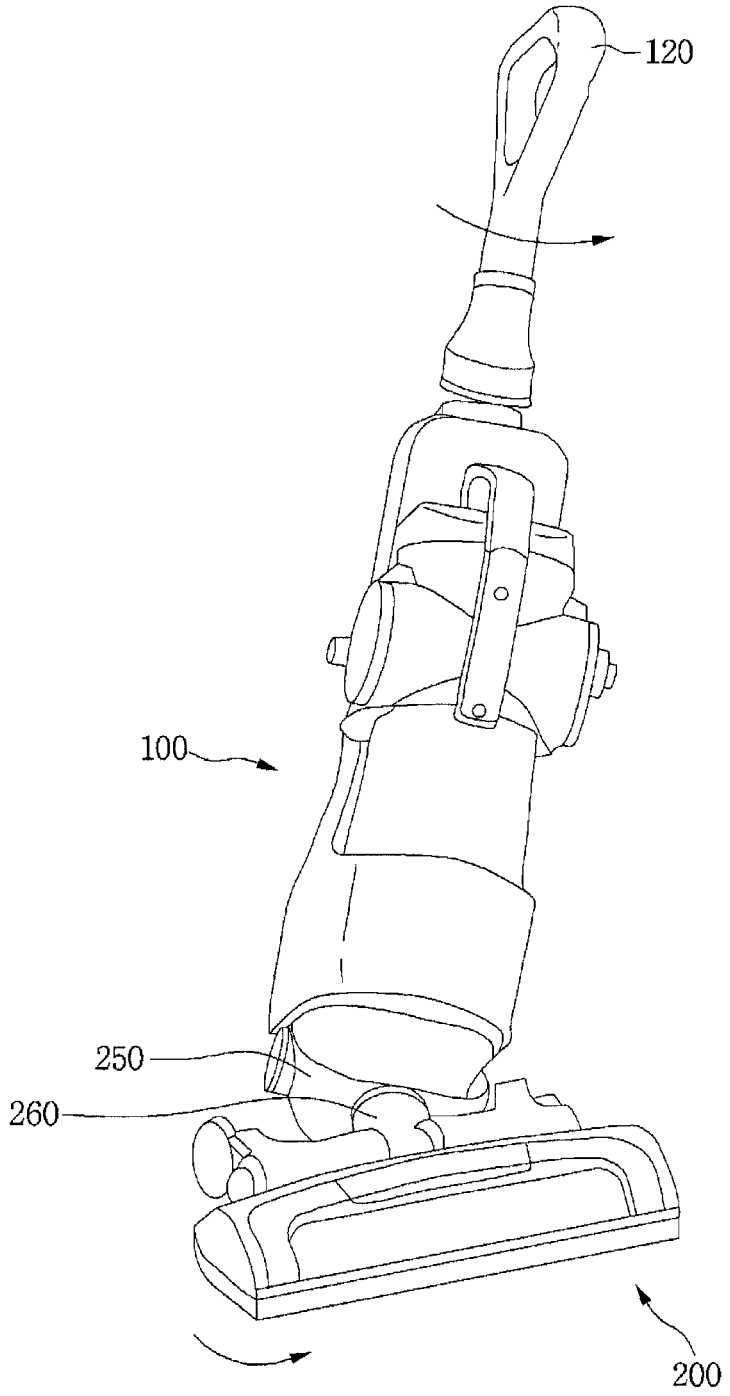
FIG. 6 is a view illustrating a state in which the cleaner body according to an embodiment is rotated left.
Figure 7:
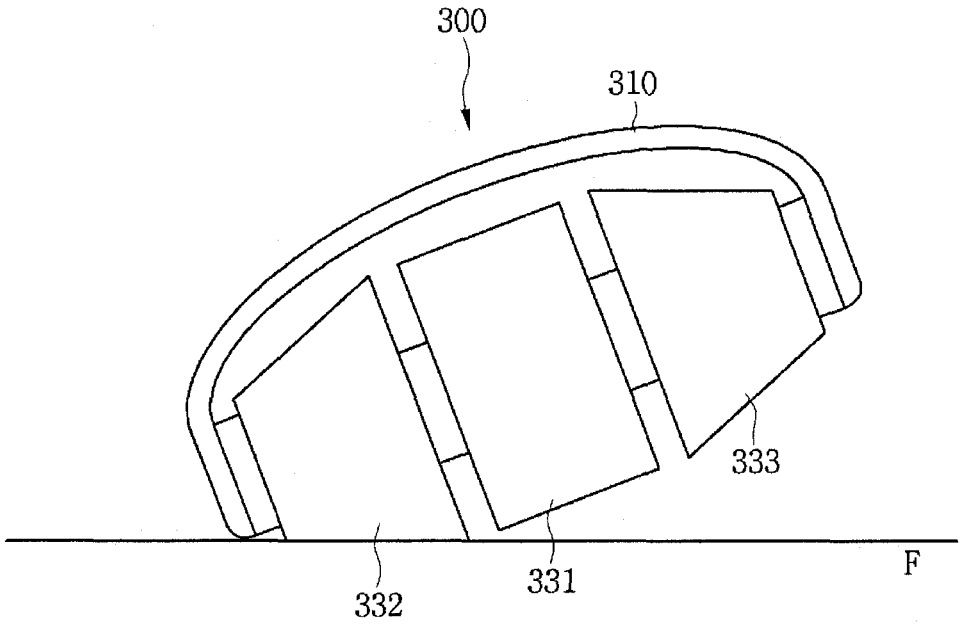
FIG. 7 is a view illustrating the wheel assembly when the cleaner body according to an embodiment is rotated right.
Figure 8:
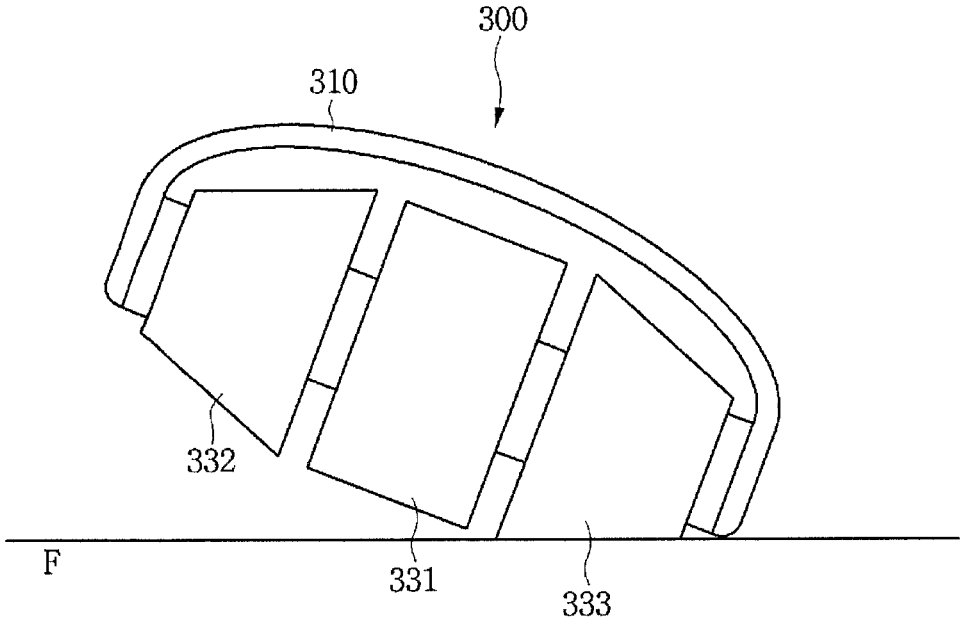
FIG. 8 is a view illustrating the wheel assembly when the cleaner body according to an embodiment is rotated left.

FIG. 5 is a view illustrating a state in which a cleaner body according to an embodiment is rotated right. FIG. 6 is a view illustrating a state in which the cleaner body according to an embodiment is rotated left. FIG. 7 is a view illustrating the wheel assembly when the cleaner body (according to an embodiment) is rotated right. FIG. 8 is a view illustrating the wheel assembly when the cleaner body (according to an embodiment) is rotated left. Other embodiments and configurations may also be provided.

Referring to FIGS. 5 and 7, when the user intends to turn right a movement direction of the vacuum cleaner 10 during a cleaning operation, the user turns right the cleaner body 100 with the handle 120 grasped by the user.

The supporter 250 is rotated right with respect to the suction nozzle 200 by a right turning force applied to the cleaner body 100.

The connection shaft 290 is also rotated right due to the supporter 250, which is rotated right. At this time, since the extension direction of the connection shaft 290 does not coincide with the first rotational center as a rotational center of the supporter 250, the connection shaft 290 is also rotated with respect to the supporter 250.

Therefore, the wheel assembly 300 is rotated right by rotation of the connection shaft 290. As shown in FIG. 7, the first wheel 331 is spaced apart from a floor F (or surface), and the tapered portion of the second wheel 332 is in contact with the floor F (or surface).

Accordingly, the vacuum cleaner 10 may be moved by the second wheel 332 and the nozzle wheel 220 provided at the suction nozzle 200. The vacuum cleaner 10 is moved right by the tapered portion of the second wheel 332, while being moved forward.

Referring to FIGS. 6 and 8, when the user intends to turn left the movement direction of the vacuum cleaner 10 during the cleaning operation, the user turns left the cleaner body 100 with the handle 120 grasped by the user.

The supporter 250 is rotated left with respect to the suction nozzle 200 by a left turning force applied to the cleaner body 100.

The connection shaft 290 is also rotated left due to the supporter 250, which is rotated left. Since the extension direction of the connection shaft 290 does not coincide with the first rotational center as a rotational center of the supporter 250, the connection shaft 290 is also rotated with respect to the supporter 250.

Therefore, the wheel assembly 300 is rotated left by rotation of the connection shaft 290. As shown in FIG. 8, the first wheel 331 is spaced apart from the floor F, and the tapered portion of the third wheel 333 is in contact with the floor F.

Accordingly, the vacuum cleaner 10 may be moved by the third wheel 333 and the nozzle wheel 220 provided at the suction nozzle 200. The vacuum cleaner 10 is moved left by the tapered portion of the third wheel 333, while being moved forward.

While the vacuum cleaner is turned left or right, the contact area between the first wheel and the floor is varied, the contact area between the second wheel and the floor is varied, and the contact area between the third wheel and the floor is varied.

While the vacuum cleaner is turned left or right, the contact area between one (e.g., the first wheel) of the plurality of wheels and the floor is decreased, and the contact area between another one (e.g., the second wheel or the third wheel) and the floor is increased.

In other words, the total number of wheels that are in contact with the floor may vary according to a position of the cleaner body with respect to the suction nozzle.

Accordingly, when the user rotates the cleaner body to turn the vacuum cleaner, the wheel assembly is rotated with respect to the suction nozzle, and thus the vacuum cleaner may be easily turned during the cleaning operation.

While the vacuum cleaner is moved forward or backward, some of the plurality of wheels are spaced apart from the floor, and thus the vacuum cleaner may be smoothly moved. The contact area between the plurality of wheels and the floor is prevented from being increased during a turning process, and thus the turning process may be smoothly performed.

Figure 9:
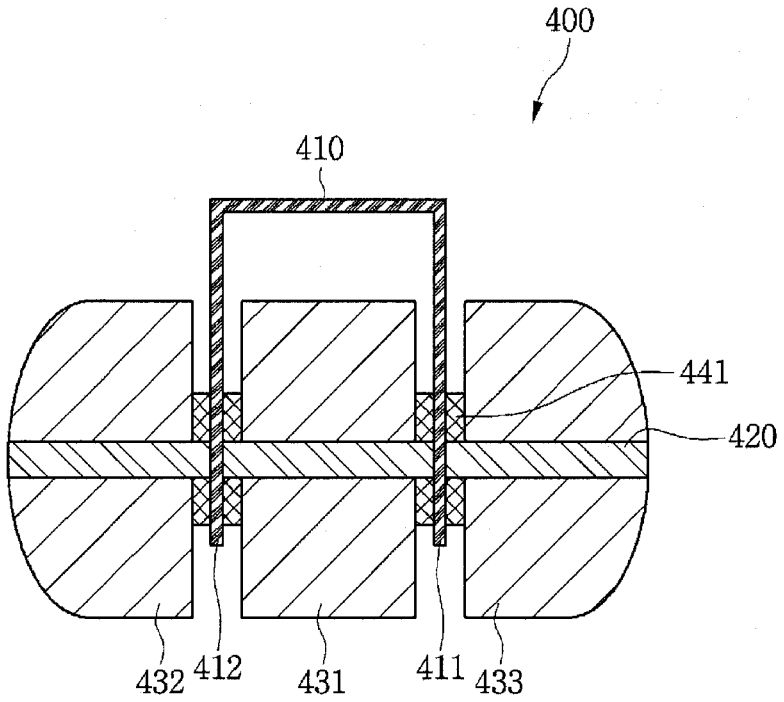
FIG. 9 is a cross-sectional view of a wheel assembly according to an embodiment.

FIG. 9 is a cross-sectional view of a wheel assembly according to an embodiment. Other embodiments and configurations may also be provided.

The embodiment has the same structure as previous embodiment, except a structure of the wheel assembly. Therefore, only a characteristic portion of the embodiment may hereafter be described, and description of other portions that are the same as those of the previous embodiment may be omitted.

Referring to FIG. 9, a wheel assembly 400 may include a frame 410, a wheel shaft 420 installed at the frame 410, and a plurality of wheels rotatably coupled to the wheel shaft 420.

The frame 410 may include a plurality of shaft supporting parts 411 and 412 that support the wheel shaft 420. The plurality of shaft supporting parts 411 and 412 may be horizontally spaced apart from each other. The wheel shaft 420 may pass through the plurality of shaft supporting parts 411 and 412.

The plurality of wheels may include a first wheel 431 located between the plurality of shaft supporting parts 411 and 412, a second wheel 432 located at a side of a second supporting part 412 (of the plurality of shaft supporting parts 411 and 412), and a third wheel 433 located at a side of a first supporting part 411 (of the plurality of shaft supporting parts 411 and 412).

The second supporting part 412 may be located between the first wheel 431 and the second wheel 432, and the first supporting part 411 may be located between the first wheel 431 and the third wheel 433. An interference preventing part 441 may be provided between the plurality of wheels to allow the plurality of wheels to be independently rotated in a state in which the plurality of wheels are coupled to the wheel shaft. The interference preventing part 441 may be provided between the second wheel 432 and the second supporting part 412 and between the second supporting part 412 and the first wheel 431.

The interference preventing part 441 may be provided between the first wheel 431 and the first supporting part 411, and between the first supporting part 411 and the third wheel 433.

Shapes of the first to third wheels 431, 432 and 433 may be the same as the shape shown in FIG. 3 or 4.

Based on this embodiment, the vacuum cleaner may also be easily turned during the cleaning operation.

Figure 10:
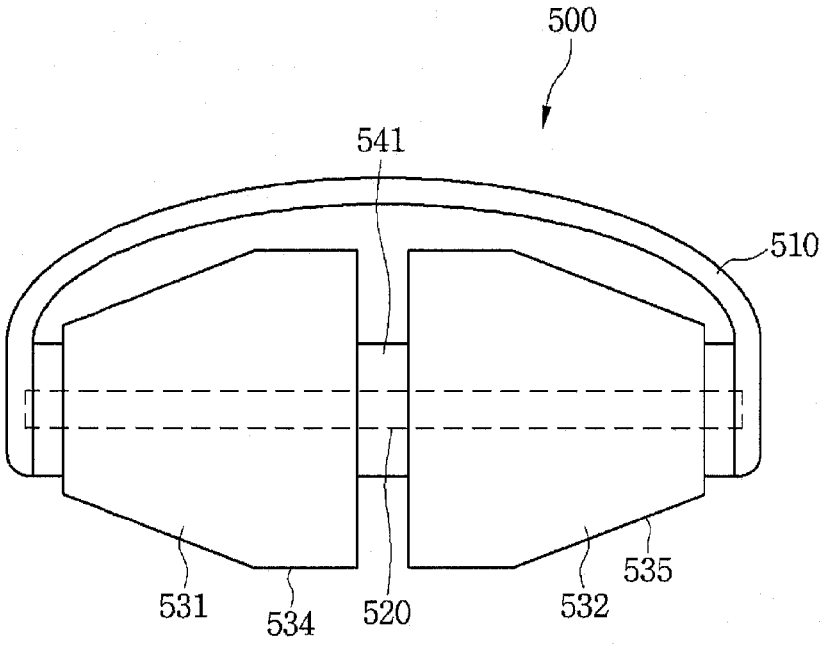
FIG. 10 is a view illustrating a wheel assembly according to an embodiment.

FIG. 10 is a view illustrating a wheel assembly according to an embodiment. Other embodiments and configurations may also be provided.

The embodiment has the same structure as the previous embodiment, except a structure of the wheel assembly. Therefore, only a characteristic portion of the embodiment may be described, and description of other portions that are the same as those of the previous embodiment may be omitted.

Referring to FIG. 10, a wheel assembly 500 may include a frame 510, a wheel shaft 520 at the frame 510, and a plurality of wheels that are rotatably installed at the wheel shaft 520.

The plurality of wheels may include a first wheel 531 and a second wheel 532 that are formed to have the same shapes and disposed to be symmetrical. A part of each of the first and second wheels 531 and 532 may contact the floor, and the other part of each of the first and second wheels 531, 532 may be spaced apart from the floor.

For example, each of the first and second wheels 531 and 532 may have a cylindrical portion 534 and a tapered portion 535.

When the external force is not applied to the cleaner body, the cylindrical portions 534 of the first and second wheels 531 and 532 may contact the floor. On the other hand, when the external force is applied to the cleaner body to turn the vacuum cleaner, the cylindrical portion 534 of one of the first and second wheels 531 and 532 may be spaced apart from the floor, the tapered portion 535 of the other one of the first and second wheels 531, 532 may contact the floor.

Embodiments may be directed to providing a vacuum cleaner.

According to an aspect, there is provided a vacuum cleaner including a suction nozzle; a cleaner body in communication with the suction nozzle; a supporter configured to connect the cleaner body with the suction nozzle and to allow a position of the cleaner body with respect to the suction nozzle to vary; and a wheel assembly rotatably connected to the supporter. The wheel assembly may include a frame, a wheel shaft installed at the frame, and wheels installed at the wheel shaft to be independently rotated. A contact area between each of the wheels and a floor may vary according to a varied position of the cleaner body with respect to the suction nozzle.

According to another aspect of the present disclosure, there is provided a vacuum cleaner including a suction nozzle; a cleaner body in communication with the suction nozzle; a supporter configured to connect the cleaner body with the suction nozzle and to allow a position of the cleaner body with respect to the suction nozzle to be varied; and a wheel assembly connected to the supporter. The wheel assembly may include a frame rotatably connected to the supporter by a shaft, a wheel shaft installed at the frame, and wheels installed at the wheel shaft. A total number of wheels that are in contact with a floor may vary according to a varied position of the cleaner body with respect to the suction nozzle.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a suction nozzle;

a cleaner body;

a supporter to connect the cleaner body to the suction nozzle, and the supporter is configured to allow a position of the cleaner body to vary with respect to the suction nozzle; and a wheel assembly to be rotatably connected to the supporter, wherein the wheel assembly includes a frame, a straight wheel shaft at the frame, and a plurality of wheels at the straight wheel shaft to independently rotate at the wheel shaft, wherein the frame includes a first shaft supporting part and a second shaft supporting part, and wherein the straight wheel shaft has a first end to be supported by the first shaft supporting part and a second end to be supported by the second shaft supporting part, and the straight wheel shaft to extend in straight axial direction from the first shaft supporting part to the second shaft supporting part, and wherein a contact area between each of the wheels and a surface to vary based on a varied position of the cleaner body with respect to the suction nozzle, wherein the plurality of wheels are provided on the straight wheel shaft, and the plurality of wheels includes a first wheel, a second wheel and a third wheel, the first wheel is located on the straight wheel shaft between the second wheel and the third wheel, wherein the first wheel to be independently rotatable about the straight wheel shaft, the second wheel to be independently rotatable about the straight wheel shaft, and the third wheel to be independently rotatable about the straight wheel shaft, wherein the second wheel has a tapered portion, and the third wheel has a tapered portion, wherein when the position of the cleaner body varies with respect to the suction nozzle, the tapered portion of a first one of the second wheel and the third wheel contacts the surface, and a second one of the second wheel and the third wheel is spaced from the surface, wherein the first one of the second wheel and the third wheel rotates about the straight wheel shaft when the tapered portion of the first one of the second wheel and the third wheel is in contact with the surface.

2. The vacuum cleaner of claim 1, wherein the surface is a floor.

3. The vacuum cleaner of claim 1, wherein when an external force is not applied to the cleaner body, the contact area between the surface and one of the first wheel and the second wheel is different from the contact area between the surface and the other one of the first wheel and the second wheel.

4. The vacuum cleaner of claim 3, wherein a shape of the first wheel is different from a shape of the second wheel, and the shape of the first wheel is different from a shape of the third wheel.

5. The vacuum cleaner of claim 1, wherein a shape of the third wheel is same as a shape of the second wheel, the second and third wheels are disposed to be symmetrical with respect to the first wheel.

6. The vacuum cleaner of claim 1, wherein when an external force is not applied to the cleaner body, at least part of the second wheel and the third wheel is spaced from the surface.

7. The vacuum cleaner of claim 1, wherein when the position of the cleaner body varies with respect to the suction nozzle, the first wheel is spaced from the surface.

8. The vacuum cleaner of claim 1, wherein one of the plurality of wheels are between two of the shaft supporting parts.

9. The vacuum cleaner of claim 1, further comprising an interference preventing part is provided between at least two of the wheels to prevent friction between the at least two wheels.

10. A vacuum cleaner comprising:

a suction nozzle;

a cleaner body;

a supporter to connect the cleaner body to the suction nozzle, and the supporter is configured to allow a position of the cleaner body to vary relative to the suction nozzle; and a wheel assembly to connect to the supporter, wherein the wheel assembly includes a frame to be rotatably connected to the supporter, a straight wheel shaft at the frame, and first and second wheels at the straight wheel shaft, wherein the frame includes a first shaft supporting part and a second shaft supporting part, and wherein the straight wheel shaft has a first end to be supported by the first shaft supporting part and a second end to be supported by the second shaft supporting part, and the straight wheel shaft to extend in straight axial direction from the first shaft supporting part to the second shaft supporting part, and wherein the first and second wheels are formed to have a same shape, and the first and second wheels are disposed to be symmetrical, and each of the first and second wheels includes a cylindrical portion and a tapered portion, wherein when an external force is not applied to the cleaner body, the cylindrical portion of each of the first and second wheels contacts a surface, and wherein when the position of the cleaner body varies with respect to the suction nozzle, the tapered portion of a first one of the first wheel and the second wheel contacts the surface, and the cylindrical portion of a second one of the first wheel and the second wheel is spaced from the surface.

11. The vacuum cleaner of claim 10, wherein the first and second wheels are to independently rotate relative to the straight wheel shaft.

12. The vacuum cleaner of claim 10, wherein a length of the tapered portion of each of the first and second wheels in the straight axial direction is longer than a length of the cylindrical portion of each of the first and second wheels.

* * * * *